United States Patent [19]

Fiebig

[11] 4,216,997

[45] Aug. 12, 1980

[54] GRAB EXCAVATOR WITH FIXED JIB

[75] Inventor: Horst Fiebig, Brunswick, Fed. Rep. of Germany

[73] Assignee: Stichweh Verwaltungs-GmbH, Hameln, Fed. Rep. of Germany

[21] Appl. No.: 5,973

[22] Filed: Jan. 24, 1979

[51] Int. Cl.[3] ..... E02F 3/44; E02F 7/06

[52] U.S. Cl. ..... 299/9; 37/71; 414/143; 414/139

[58] Field of Search ..... 414/138–140, 414/143; 171/138; 37/71; 299/7–9; 175/88

[56] References Cited

U.S. PATENT DOCUMENTS

| | | | |
|---|---|---|---|
| 1,396,193 | 11/1921 | Godin | 414/139 |
| 2,265,570 | 12/1941 | Nicol | 299/9 |
| 3,704,796 | 12/1972 | Dedons et al. | 414/139 |

*Primary Examiner*—Ernest R. Purser
*Attorney, Agent, or Firm*—Salter & Michaelson

[57] ABSTRACT

A grab excavator of the kind having a fixed jib, a liftable grab supported by the jib and a chute articulated about a horizontal axis for pivoting between an operative position in which the chute is directed obliquely downwards to receive material released from the grab and an inoperative position in which the chute is positioned downwardly out of the path of the grab. When the chute is in its operative position the lower end communicates with a feed device which includes a sieve forming a downward extension from the lower end of the chute. The chute is pivoted into and out of its operative position by a hydraulic ram engaging the underside of the chute.

7 Claims, 2 Drawing Figures

GRAB EXCAVATOR WITH FIXED JIB

The invention concerns a grab excavator having a fixed jib, a liftable grab supported by the jib and a chute capable of pivoting in the path of the grab, said chute being articulated on the jib or other supporting structure and directed in its operative position obliquely downwards away from the jib, and being aligned at its delivery end when in its operative position with a feed device.

In a known excavator of the foregoing type, the chute includes a straight limb and a fork-shaped limb slightly bent at its free end. The limbs are approximately perpendicular to each other. The straight limb serves to guide the material delivered by the grab and hangs perpendicularly downwards in its inoperative rest position. The chute is mounted to pivot on a trestle approximately at the centre of its fork-shaped limb and, in the inoperative rest position, this limb hangs approximately horizontally in such a way that it projects into the path of the grab and is moved along by the outward moving grab or by a stop on the upper end of said grab so that the chute is moved into its operative or working position (German Gebrauchsmuster No. 1,698,097).

However this device has the disadvantage that the grab or the stop impinges on the limb of the chute with the full velocity of the stroke on each occasion and the grab has to exert the retaining force for the chute in its working position.

An object of the invention is to provide a device which brings the pivoted chute into its operative position in relation to the movement of the grab smoothly and at the earliest possible moment.

According to the invention, this object is solved in that a hydraulic ram engaging with the underside of the chute is provided to pivot the chute and this actuates the chute automatically in relation to the movement of the grab, and enables the chute to pivot closely behind the outward travelling grab so that as much as possible of the flowing fine sand, mixed with water, is collected.

A problem also exists in bringing about the removal of coarse-grained material. For this purpose a downwardly sloping sieve is arranged as an extension of the chute in its operative position, said sieve being provided with a peripheral wall which increases in depth towards the lower end of the sieve. In this way there is produced a collecting space in the form of a tray which needs to be emptied at long intervals only. For this purpose the sloping sieve is arranged to tip to raise the sieve from its normal position in which it forms the downward extension of the chute.

One embodiment of grab excavator in accordance with the invention is now described by way of example with reference to the accompanying drawings, in which.

Figure 1:
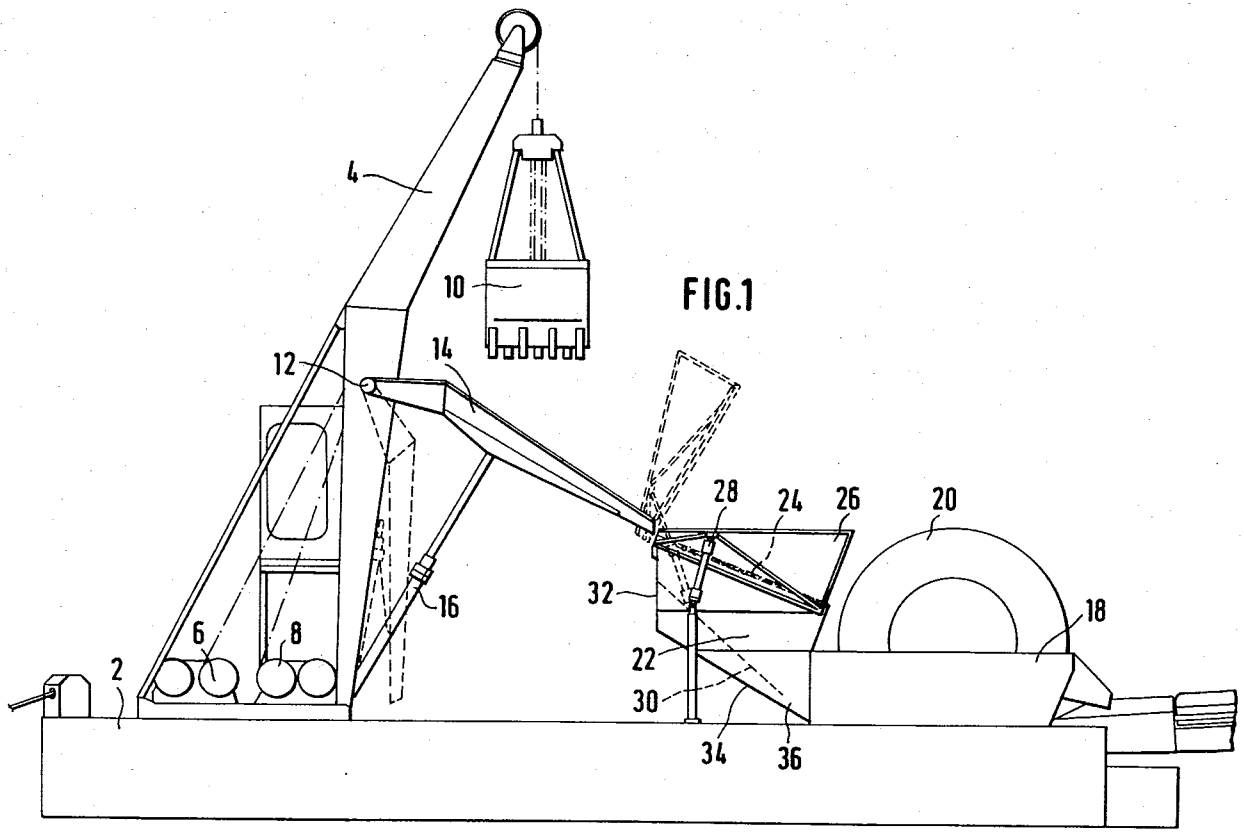
FIG. 1 shows a side view of the grab excavator.
Figure 2:
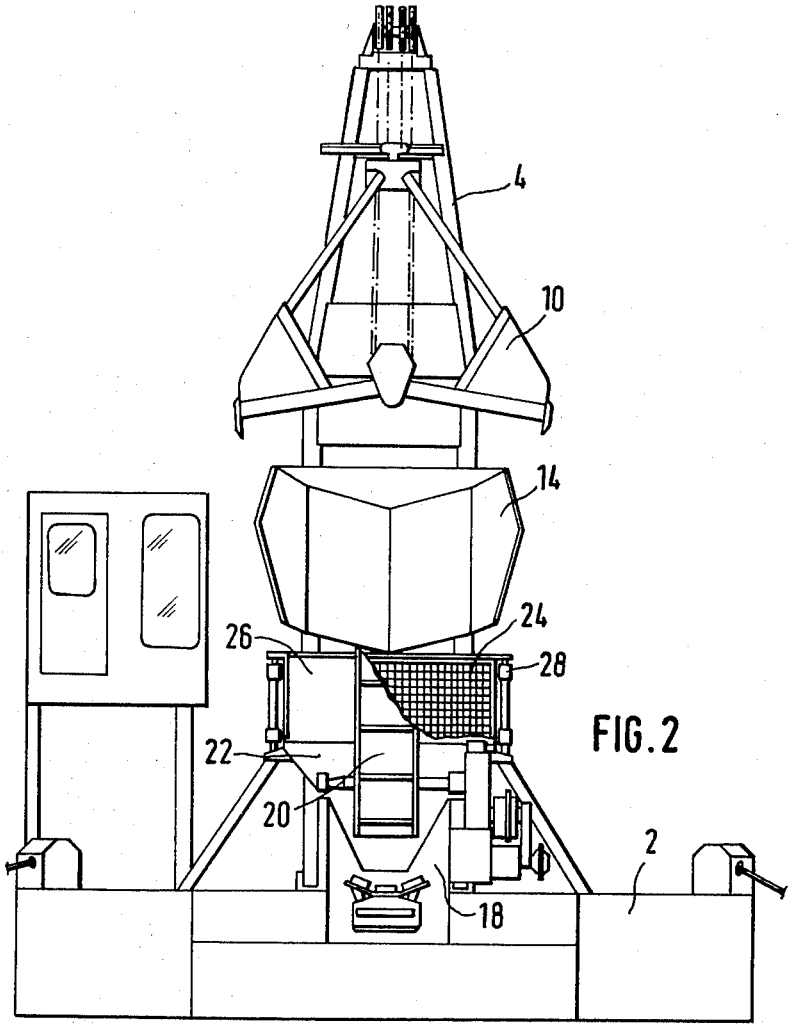
FIG. 2 shows a front view of the grab excavator.

The grab excavator comprises a fixed jib 4, with which there are coordinated the winding assemblies 6 and 8 for the stroke and closure cables of the grab which is supported by the fixed jib 4. The jib is mounted on a pontoon 2.

A chute 14 in the form of a trough is mounted by a pivot 12 on the jib 4 and is pivoted by a hydraulic ram 16, pivotally mounted at its lower end on the jib 4 or on the bedplate of said jib, the piston rod of the ram being pivotally connected at its free end to the underside of the chute 14.

The chute 14 is illustrated in FIG. 1 in full lines in its working position and in dashed lines in its inoperative position.

At the end of the pontoon 2 remote from the jib 4 there is an intermediate sand container 18 provided with a dewatering bucket wheel 20, known in itself. The intermediate sand container 18 is provided with a feed funnel 22, above the input of which there is arranged a sloping sieve 24 mounted in such a way that when the chute 14 is in its operative position, the sieve 24 lies in a plane which is an extension of said chute 14. The sloping sieve 24 is mounted in a strainer 26 of which the walls increase in height towards the lower end of the sieve so as to define with the sieve a tray-like strainer of a prismatic shape. This strainer 26 is pivoted at its end adjacent the free end of the chute 14 on the feed funnel 22 and can be tipped by means of a hydraulic ram 28 from the position shown in FIG. 1 in full lines to the position shown therein by dashed lines.

When the grab 10 is to be lowered from the position illustrated in FIG. 1 through the pontoon 2, the chute 14 is swung down into the position shown in dashed lines. When the filled grab is lifted, the hydraulic ram 16 can be operated to extend the piston thereof immediately after the grab has passed through the pontoon 2, so that it is possible for the chute 14 to be in the operative position, shown in full lines in FIG. 1, even before the grab 10 has reached its upper position as illustrated. In this way, water mixed with fine sand is discharged onto the chute 14 and is directed into the intermediate sand container 18 from the earliest possible moment so that losses of fine sand are reduced to a minimum. The operation of the hydraulic ram 16 may conveniently occur automatically in relation to the operation of the grab 10.

Since water mixed with fine sand may be deposited by the grab 10 onto the chute even during the outward pivoting of the chute 14 into the position illustrated in full lines in FIG. 1, the feed funnel 22 may be designed to be open at the end facing the chute 14 so as to further decrease the losses of fine sand. In addition it may be convenient to arrange an auxiliary funnel 34 beneath the feed funnel 22 in which the slope of the lower wall 30 thereof is fixed, said auxiliary funnel 34 also being open at its front end and connected through an opening 36 with the intermediate sand container 18. The lower wall of the auxiliary funnel 34 may be designed to be of a less slope than the wall 30, since the fine sand is flushed into the intermediate sand container 18 with a high water content. In operation of the embodiment described, the water mixed with fine sand is collected right up to the lower end of the opening 32 thus ensuring that a large quantity of fine sand is collected.

Owing to the sloping arrangement of the sieve 24 and the ability to pivot the sieve to increase its slope temporarily, wedging of coarse-grained sand in the sieve 24 is prevented. The coarse-grained material collects at the lower end of the strainer 26 and is emptied as necessary by tipping the strainer 26. This may take place towards the front as is shown in the example of embodiment illustrated. The strainer 26 could also, obviously, be designed to be able to tip sideways, where another intermediate sand container could then be arranged close beside the sieve.

The pivot joint 12 of the chute 14 may be arranged on an independent supporting structure instead of on the jib 4. In addition, it would also be possible, if necessary, to carry out the pivoting of the chute by means of cables. Similarly a cable may be provided for tipping the strainer 26.

What I claim as my invention and desire to secure by Letters Patent of the United States is:

1. A grab excavator, comprising a base defined by a floating pontoon, a fixed jib mounted on said pontoon, a grab suspended from said jib, means mounted on said pontoon and interconnected to grab through said jib for vertically moving said grab, wherein said grab is lowered below said pontoon for lifting a mixture of sand and water and thereafter elevated above said pontoon for releasing the mixture, a chute mounted on said jib and pivotal about a horizontal axis thereon for location beneath the grab in an inclined operative position and being pivotally movable to a vertical inoperative position and out of the path of said grab, a feed device located at the lower end of said chute when it is disposed in the inclined operative position and receiving the sand-water mixture therein as directed thereto by said chute, a hydraulic ram mounted on said pontoon and engaging the underside of said chute, said ram being operable to pivotally move said chute between the operative and inoperative positions thereof, said feed device further including a sieve that normally is located in a downwardly inclined position adjacent to said chute and being disposed at substantially the same angle of inclination thereof to form an extension of said chute when the chute is located in the operative position wherein said sieve receives the sand-water mixture from said chute for processing through said feed device, and an opening formed in said feed device in the wall thereof that faces in the direction of said chute, said opening receiving therein the mixture of said and water from said chute as the chute is being raised to the full operative inclined position, thereby preventing the loss of fine sand that may escape from said grab before the chute is fully raised to the operative position thereof.

2. A grab excavator as claimed in claim 1, said feed device including a strainer the walls of which increase in height toward the lower end of said device, said sieve being located in said strainer and defining the bottom wall thereof.

3. A grab excavator as claimed in claim 2, said strainer with the sieve located therein being pivotally movable at the end thereof that is adjacent to the lowermost end of said chute, wherein wedging of coarse-grained material is prevented from occurring at the lower end of said strainer.

4. A grab excavator as claimed in claim 3, a hydraulic ram connected to said strainer for effecting the pivotal movement thereof and said sieve.

5. A grab excavator as claimed in claim 1, the wall in which said opening is located being formed as part of a feed funnel that is disposed beneath said strainer, said feed funnel including a lower wall that communicates with said opening for directing the fine sand received through said opening to a collection area.

6. A grab excavator as claimed in claim 5, an auxiliary funnel being located beneath said feed funnel, and a second opening located in the wall facing the chute and communicating with said auxiliary funnel for directing fine sand and water to said collection area.

7. A grab excavator as claimed in claim 6, said auxiliary funnel having a lower wall on which the sand and water mixture is deposited that has a slope that is less than that of the wall in the main funnel located thereabove.

* * * * *